United States Patent [19]

Hall

[11] 4,081,311

[45] Mar. 28, 1978

[54] CEMENTING MACHINE FOR EDGE FOLDING OR BINDING

[75] Inventor: Dennis Sidney Hall, Leicester, England

[73] Assignee: USM Corporation, Boston, Mass.

[21] Appl. No.: 801,758

[22] Filed: May 31, 1977

[30] Foreign Application Priority Data

Jun. 5, 1976 United Kingdom ..... 23347/76

[51] Int. Cl.[2] ..... A43D 25/02

[52] U.S. Cl. ..... 156/475; 156/538

[58] Field of Search ..... 156/475, 477 R, 478, 156/479, 480, 216, 538; 12/57; 118/209, 210

[56] References Cited

U.S. PATENT DOCUMENTS 3,328,816 7/1967 Crimella ..... 12/57

FOREIGN PATENT DOCUMENTS 189,503 11/1922 United Kingdom ..... 156/480

*Primary Examiner*—William A. Powell
*Assistant Examiner*—William H. Thrower
*Attorney, Agent, or Firm*—Carl E. Johnson; Richard B. Megley; Vincent A. White

[57] ABSTRACT

Mechanism is provided whereby, at the option of an operator, a cementing machine may conveniently be converted from an edge folding arrangement to an edge binding arrangement, or vice versa. Instead of requiring services of a mechanic for the purpose, the operator simply mounts the appropriate finger and gauge block and positions a locking lever for the desired mode of operation.

The invention is particularly suitable for operating on uppers of shoes but its utility is applicable to other flexible sheet workpieces.

7 Claims, 4 Drawing Figures

CEMENTING MACHINE FOR EDGE FOLDING OR BINDING

BACKGROUND OF THE INVENTION

This invention is concerned with improvements in or relating to edge folding machines, that is folding machines of the type which operate on margins of workpieces, e.g. shoe uppers, to fold over a portion of such workpiece presented to the machine.

Edge folding machines are primarily used for two distinct operations: firstly, for an edge folding operation, in which a marginal portion of a workpiece is folded over on itself, and, secondly, for an edge binding operation, in which a portion of binding tape previously attached to the margin of the workpiece, e.g. by stitching, is folded over the edge of the workpiece and is secured to the workpiece margin.

Customarily the folded over portion, whichever operation is carried out, is secured to the workpiece margin by adhesive. Usually, the adhesive is supplied to the workpiece through a so-called creaser foot of the machine. Machines having such a creaser foot are usually referred to as "cementing and folding machines."

Although machines for carrying out a folding operation and machines for carrying out a binding operation usually have a large number of parts in common, it has been the practice in the past to supply separate machines for the two distinct operations. The essential difference between the parts required for these operations is that, for folding, a so-called gauge finger is used, which, when in an operative position, co-operates with a shaped gauge between the finger and the block thus to initiate a fold in the workpiece margin, while, for binding, a so-called binding finger is used, against which the edge of the workpiece abuts, with the binding tape passing beneath the finger; for this latter purpose, a generally flat gauge block is used, having a groove which lies beneath the binding finger.

In both cases, adhesive is then applied in the area of the fold, a so-called lip turner folds the portion over, whereafter the fold is consolidated by a presser arrangement, e.g. hammer and anvil arrangement, which serves also to feed the work through the machine.

For binding, a wiper element is usually also provided, mounted for movement just in advance of the hammer and anvil arrangement to ensure a "tight" fold. For folding, a snipping knife may be provided by which the portion to be folded can be progressively snipped; snipping usually takes place when an "inside" curve of a workpiece margin is being folded.

Because of the different uses to which the gauge finger on the one hand and the binding finger on the other hand are put, it is generally considered desirable to vary the movement thereof into and out of an operative position. Thus, when a gauge finger is used for a folding operation, it is desirable to give the workpiece maximum access to "ride up" the shaped gauge block; this is especially the case, for example, where a seam runs transversely of the margin of the workpiece. In such a case, therefore, it is desirable that the gauge finger is retracted not only heightwise of the gauge block which movement alone would in no way act to enlarge the width of the gap between the guage finger and guage block, but also laterally relative to the guage block, in order that the gap can thus be enlarged; such movement heightwise and laterally will be hereinafter referred to as "up-and-away" movement. In a binding operation, on the other hand, it is most desirable that the operator can gauge where the edge of the workpiece, as opposed to the binding tape, will lie in the machine for a binding operation, so that it is desirable that the binding finger moves heightwise only relative to the gauge block; such movement is hereinafter referred to as "vertical (or substantially vertical) movement." Furthermore it will be appreciated that, if the binding finger were to effect an up-and-away movement, it could well interfere with the movement of a workpiece by the operator into an operating condition, in that it could trap the workpiece against the gauge block.

In order to convert a folding machine for a binding operation, therefore, a relatively complex attachment has been provided, in the past, which attachment provides for vertical sliding movement of the binding finger. In using this attachment, however, the gauge has to be removed. Thus, the operation of changing from folding to binding, or vice versa, has to be carried out by a mechanic rather than the usual operator, and furthermore the machine is out of use for a relatively long period, thereby giving rise to a loss of production.

It is therefore one of the various objects of the present invention to provide an improved edge folding machine in which the change from a binding operation to a folding operation, or vice versa, can readily be made by the operator of the machine with the minimum of loss of production.

There is hereinafter described in detail, to illustrate the present invention by way of example, an edge folding machine, hereinafter called "the illustrative machine," this illustrative machine comprising a work table, a support arranged above the work table by which a creaser foot can be supported for movement into and out of an operative position, a carrier which is mounted above the work table and on which a gauge can be mounted for co-operating, when in an operative position, with a gauge block mounted on the work table, and workpiece feeding means in the form of a hammer and anvil arrangement which is also effective to complete and consolidate the folding over of a portion of the workpiece, whether, as in a folding operation, a marginal portion folded over on itself, or, in a binding operation, a binding tape folded over on the workpiece margin.

The carrier for the finger element, to which a selected finger element can be readily secured by a single screw, and can thus readily be exchanged by the operator, is mounted either for up-and-away movement (as hereinbefore defined) relative to the gauge block, or for vertical (or substantially vertical) movement relative thereto, whereby to bring a finger element mounted on the carrier into and out of its operative position. Furthermore, the illustrative machine comprises actuator means for effecting movement of the carrier as aforesaid, and selector means whereby either up-and-away movement (as hereinbefore defined) of the carrier or vertical (or substantially vertical) movement thereof can be selected to take place under the action of the actuator means as aforesaid.

To this end, the carrier of the illustrative machine is supported by two spaced-apart mountings one of which is adjustable so as to vary the path of movement of the carrier under the action of the actuator means. Furthermore, the selector means comprises locking means whereby such adjustable mounting can be locked in a selected condition, whereby the carrier is constrained to move along a desired path of movement. In the illustrative machine, the adjustable mounting comprises a pin-and-slot connection, and the selection means is so arranged that a pin of said connection can be operatively connected with a selected slot portion of said connection, the arrangement being such that, according to such selection, either up-and-away movement or vertical (or substantially vertical) movement relative to the gauge block can be effected as aforesaid.

The two spaced-apart mountings for the carrier are provided by two lever arrangements, one of which is connected to the carrier by the pin-and-slot connection and the other by a further pivotal connection, the two lever arrangements themselves being mounted for pivotal movement on a frame portion of the machine.

The pin-and-slot connection referred to above comprises two pins and two slots, one pin being accommodated in each slot. The locking means is effective selectively to cause one pin of such pin-and-slot connection to be secured in position at the end of its associated slot, and thus to provide a further pivotal connection for the carrier, while the other pin is free to move along its own slot, and vice versa.

The pins are accommodated in pin-receiving holes provided in the carrier, the slots associated with the pins being provided in the one lever arrangement. The pin-receiving holes are spaced at different distances from the pivotal connection of the carrier with said other lever arrangement, whereby the distance between the two pivotal connections can thus be varied. In this manner, according to the pin selected, either up-and-away movement (as hereinbefore defined) of the carrier relative to the gauge block can be effected, or vertical (or substantially vertical) movement relative thereto.

The locking means of the illustrative machine comprises a locking lever mounted on the same pivot as said one lever arrangement, the locking lever having an aperature provided with two recess portions in each of which one of the pins can be accommodated, the arrangement being such that when one pin is accommodated in the recess portion provided therefor, the other pin is free to move in said aperture, and vice versa. Relative adjusting movement between the locking lever and said one lever arrangement is thus effective to cause one or other of the pins to be selectively locked in position as foresaid. Furthermore, the two recess portions are differently spaced from the pivot of said one lever arrangement.

The illustrative machine also comprises means, including a spring finger, for securing the locking lever and said one lever arrangement in adjustment position. The locking lever is also provided with a handle, which extends through a guard member of the machine, to be readily accessible to the operator, whereby the operator can select up-and-away movement of the carrier or vertical (or substantially vertical) movement thereof, in accordance with the operation to be performed.

The actuator means of the illustrative machine is effective to move the carrier for the finger element as aforesaid and also to move the creaser foot support of the machine heightwise thereof, said support carrying a first abutment member arranged to engage a second abutment member which is carried by the carrier for the finger element, the arrangement being such that, by engagement of two abutment members, heightwise movement of the creaser foot support is effective to cause movement of the carrier for the finger element also. For varying the amount of movement of the carrier under the action of the actuator means through the movement of the creaser foot support, one of said abutments is constituted by a pin having an eccentric portion which is arranged to engage the other abutment member, rotation of the pin being thus effective to vary the relationship between said portion and the other abutment member and thus to vary the amount of movement of the carrier. In the illustrative machine, the pin with the eccentric portion is mounted on the creaser foot support.

The creaser foot support comprises a member mounted for pivotal movement on a frame portion of the machine, the actuator means comprising an operator-actuated lever, e.g. a knee-operated lever or a treadle, connected to said member by means of a cable. In addition, the actuator means also comprises a hand-operated lever which acts on said member independently of the operator-actuated lever. Furthermore, said other lever arrangement by which the carrier for the finger element is supported is provided with an extension constituting auxiliary actuator means, in the form of a further hand-operated lever, which is effective to move the carrier independently of the creaser foot support.

When it is desired to change from a folding operation, to a binding operation in the illustrative machine, it will therefore be appreciated that the operator merely has to remove one finger element and replace it with an appropriate finger element, and in addition to replace the gauge block with one suitable for the operation to be performed, the gauge block also being secured in the work table by a single screw, and finally the operator has also to alter the position of the locking lever. The machine is now ready for the selected operation to be performed.

SUMMARY OF THE INVENTION

The invention provides, as one of its several features, an edge folding machine comprising a work table, a carrier which is mounted above the work table and on which a finger element can be mounted for co-operating, when in an operative position, with a gauge block mounted on the work table, the carrier being mounted either for up-and-away movement (as hereinbefore defined) relative to such gauge block, or for vertical (or substantially vertical) movement relative thereto, whereby to bring a finger element mounted on the carrier into and out of such operative position, actuator means for effecting movement of the carrier as aforesaid, and selector means whereby either up-and-away movement (as hereinbefore defined) of the carrier, or vertical (or substantially vertical) movement thereof can be selected to take place under the action of the actuator means as aforesaid.

The invention also provides, as another of its several features, an edge folding machine comprising a work table, a carrier which is mounted above the work table and on which a finger element can be mounted for co-operating, when in an operative position, with a gauge block mounted on the work table, and actuator means for moving the carrier whereby to bring a finger element supported thereby into and out of such operative position, wherein the carrier is supported by two spaced-apart mountings one of which is adjustable so as to vary the path of movement of the carrier under the action of the actuator means, and locking means whereby said adjustable mounting can be locked in a selected condition whereby the carrier is constrained to move along a desired path of movement.

The invention further provides, as another of its several features, an edge folding machine comprising a work table, a carrier which is mounted above the work table and on which a finger element can be mounted for co-operating, when in an operative position, with a gauge block mounted on the work table, and actuator means for moving the carrier whereby to bring a finger element supported thereby into and out of such operative position, wherein the carrier is supported by two spaced-apart mountings, one of which is provided by a pin-and-slot connection, selection means being provided whereby a pin of said connection can be operatively connected with a selected slot portion of said connection, the arrangement being such that, according to such selection, either up-and-away movement (as hereinbefore defined) of the carrier relative to such gauge block or vertical (or substantially vertical) movement relative thereto can be effected under the action of the actuator means.

The invention still further provides, as another of its several features, an edge folding machine comprising a work table, and a carrier which is mounted above the work table and on which a finger element can be mounted for co-operating, when in an operative position, with a guage block mounted on the work table, wherein the carrier is supported by two lever arrangements each of which is mounted for pivotal movement on a frame portion of the machine, the carrier being provided with two pin-receiving holes each of which can accommodate a pin by which selectively one of the lever arrangements can be pivotally connected to the carrier, and the other lever arrangement being connected to the carrier by a pivotal connection, the pin-receiving holes being spaced at different distances from the pivtal connection of the carrier with said other lever arrangement, whereby the distance between the two pivotal connections can thus be varied, the arrangement being such that, according to such selection, either up-and-away movement (as hereinbefore defined) of the carrier relative to a gauge block mounted as aforesaid or vertical (or substantially vertical) movement relative thereto can be effected, whereby to bring a finger element mounted on the carrier into and out of its operative position, the machine also comprising actuator means for effecting movement of the carrier as aforesaid.

The invention also provides, as yet another of its several features, an edge folding machine comprising a work table, and a carrier which is mounted above the work table and on which a finger element can be mounted for co-operating, when in an operative position, with a gauge block mounted on the work table, wherein the carrier is supported by two lever arrangements each of which is mounted for pivotal movement on a frame portion of the machine, and wherein one of the lever arrangements comprises a member having two slots in each of which a pin carried by the carrier is accommodated, the pins each being capable of providing a pivotal connection between said one lever arrangement and the carrier, and the other lever arrangement is pivotally connected to the carrier, the pins being spaced at different distances from the pivotal connection between said other lever arrangement and the carrier, and the arrangement being such that either up-and-away movement (as hereinbefore defined) of the carrier relative to a gauge block mounted as aforesaid or vertical (or substantially vertical) movement relative thereto can be effected, according to which pin provides the pivotal connection for said one lever arrangement, the machine also comprising selector means for selecting by means of which the two pins such pivotal connection is to be provided, said selector means comprising a locking lever mounted on the same pivot as the one lever arrangement and said locking lever having an aperture provided with two recess portions in each of which one of the pins can be accommodated, the arrangement being such that when one pin is accommodated in the recess portion provided therefor, the other pin is free to move in said aperture, and vice versa, and relative adjusting movement between said locking lever and said one lever arrangement being effective to cause one or other of the pins to be selected as aforesaid, and means being provided for securing the locking lever and said one lever arrangement in adjusted position, and the machine further comprising actuating means for effecting movement of the carrier as aforesaid.

BRIEF DESCRIPTION OF THE DRAWINGS

The above and other of the various objects and several features of the invention will become clearer from the following detailed description, to be read with reference to the accompanying drawings, of the illustrative machine. It will of course be appreciated that this illustrative machine has been selected for description merely by way of exemplification of the invention and not by way of limitation thereof.

In the accompanying drawings.

DESCRIPTION OF PREFERRED EMBODIMENT

Figure 1:
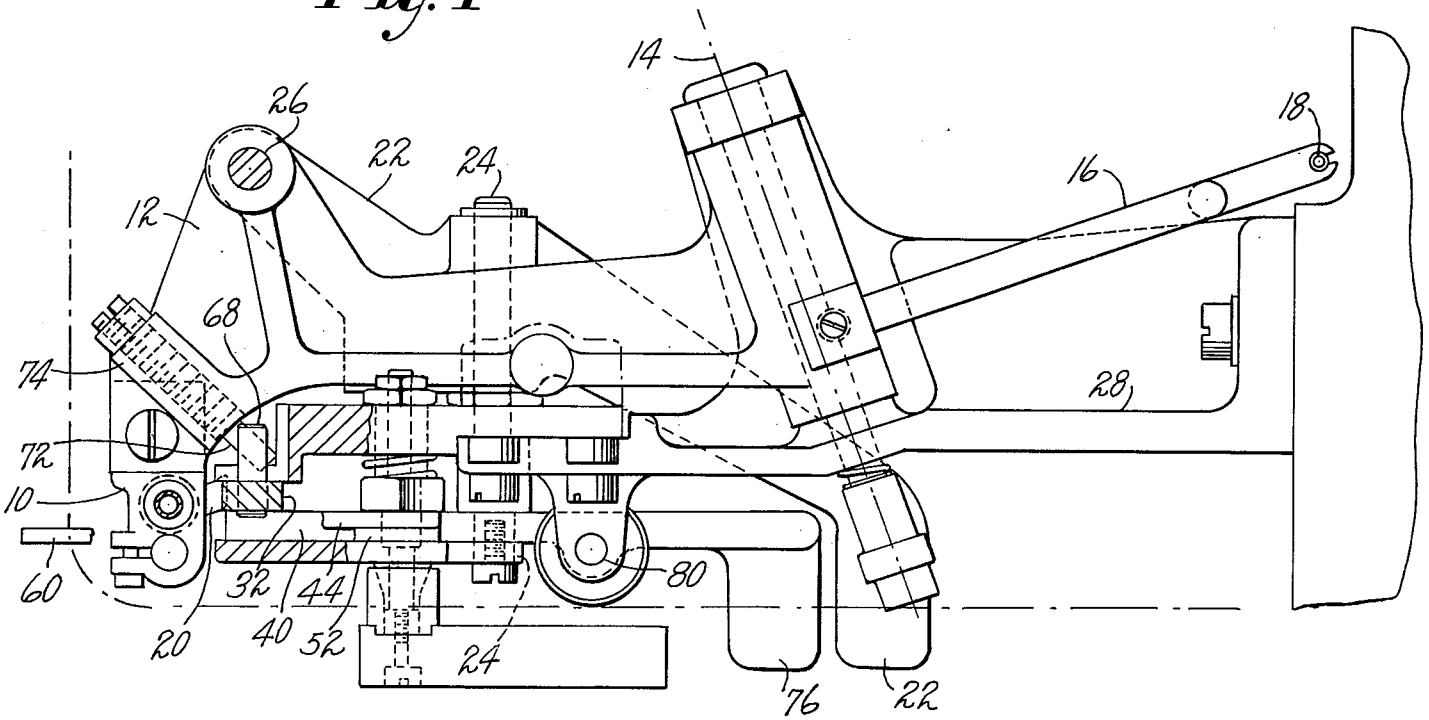
FIG. 1 is a fragmentary plan view of the illustrative machine, and partly in section, showing a creaser foot support, a carrier for a finger element and actuator means therefor.
Figure 2:
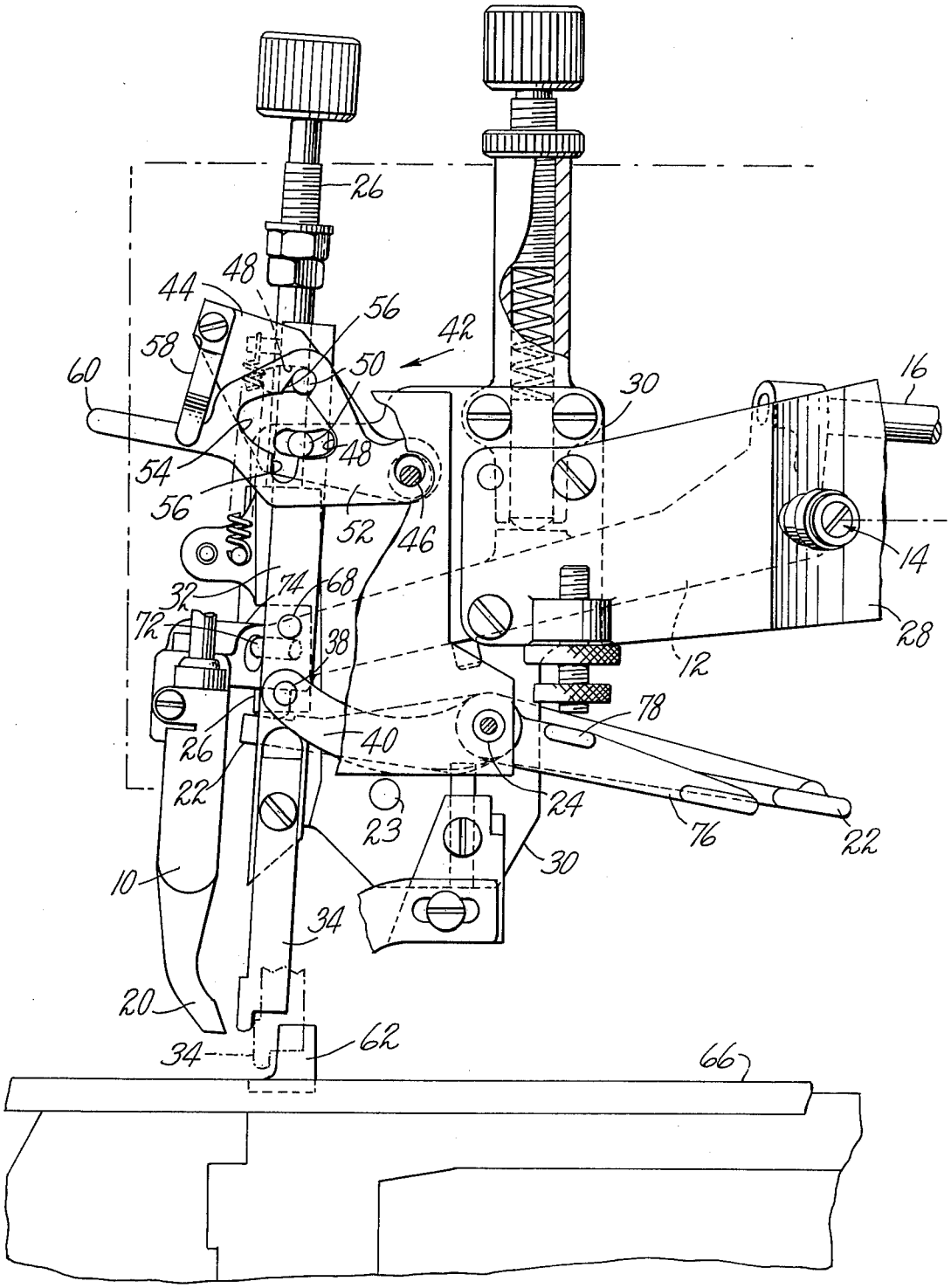
FIG. 2 is a fragmentary elevational view of parts shown in FIG. 1, with a finger element in the form of a gauge finger supported by the carrier, said finger being shown out of its operative position.

The illustrative machine is a cementing and folding machine and comprises a creaser foot support 10 carried on a bracket 12 which is pivotally supported on an axis 14 (FIGS. 1, 2). Connected to the bracket 12 is a rod 16, which in turn is connected, through a cable 18, to a knee-operated lever (not shown) mounted beneath the machine. Operation of the knee-operated lever thus causes the bracket to pivot, to bring a creaser foot 20 (FIGS. 2, 3) supported on its support 10 into and out of an operative position.

Further for thus moving the creaser foot support, a hand-operated lever 22 (FIGS. 1, 3) is provided, pivotally mounted on a pin 24, and extending beneath a pin 26 carried on the bracket 12. Thus depression of an end of the lever 22 is effective to raise the bracket 12 by pivoting it clockwise, as seen in FIG. 2, about its axis 14.

The lever 22 rests on a pin 23 (FIG. 2) thus to determine the lowermost, and thus the operative, position of the creaser foot 20, the pin 26 being mounted for heightwise adjusting movement, thus to adjust said position.

A main frame 28 of the illustrative machine, on which frame a bearing determining the axis 14 is provided, carries a support member 30 on which a carrier, in the form of a so-called lifting bar 32 (FIGS. 1–4) is mounted for movement relative to said support member. The lifting bar 32 has, at its lower end, a mounting for a finger element, which may be in the form of a detachable gauge finger 34 or a binding finger 36, according to the operation to be performed. (The pin 24 is supported at one end by the support member 30).

The lifting bar 32 is supported by two spaced-apart mountings, one of which is provided by a pivot pin 38 (FIGS. 2–4), by which the bar is connected to a lever 40 pivotally mounted on the pin 24. The other mounting is a composite assembly generally designed 42 (see FIGS. 2–4) which comprises a lever 44 pivotally mounted by means of a pin 46 on the support member 30. The lever 44 has two slots 48 therein which each receive a pin 50. The pins 50, accommodated in pin-receiving holes in the lifting bar 32, are positioned apart from the pin 38 by different distances, and all three pins lie on a center line.

The lifting bar 32 is thus capable of pivoting on either one of the pins 50, and the illustrative machine is thus provided with selector means for selecting by which pin 50 (upper or lower) the lifting bar is to be operatively supported, such selection being determined according to the path of movement desired for the lifting bar 32 and the finger carried thereby. To this end, the selector means includes locking means comprising a locking lever 52, which is also pivotally mounted on the pin 46. The locking lever 52 has a central aperture 54 with two recesses 56 therein. The recesses 56, which lie on different radii centered on the pin 46, are arranged each to receive the upper or lower one of the pins 50, according to the position of the locking lever relative to the lever 44. The arrangement is such that, when one of the pins is accommodated in its recess 56, the other pin 50 is able to move freely along its slot 48 in the lever 44 and also within the aperture 54 of the locking lever, and vice versa, so that when one pin 50 has been selected to provide the pivotal connection, the other pin 50 in no way interferes with the pivoting movement of the finger-lifting bar about the selected pin.

For securing the locking lever 52 in a selected position relative to the lever 44, a spring element 58 is carried by the lever 44 and "clips" the locking lever in that position. The locking lever is also provided with a handle 60, which extends through a guard member (not fully shown) of the machine, to be readily accessible to and shiftable by the operator.

The path of movement of the lifting bar, and of a finger element 34 or 36 supported thereby into and out of its operative position, is determined according to which pin 50 is locked as aforesaid in its recess. Thus, if it is desired that a gauge finger 34, mounted on the lifting bar 32 should effect up-and-away movement (as hereinbefore defined) out of its operative position, the upper of the two pins 50, i.e. the pin remote from the pin 38, should be locked, while if a binding finger 36 is mounted on the lifting bar 32, and it is desired to effect a vertical (or substantially vertical) movement of the bar, then the lower of the two pins should be locked as aforesaid.

Figure 3:
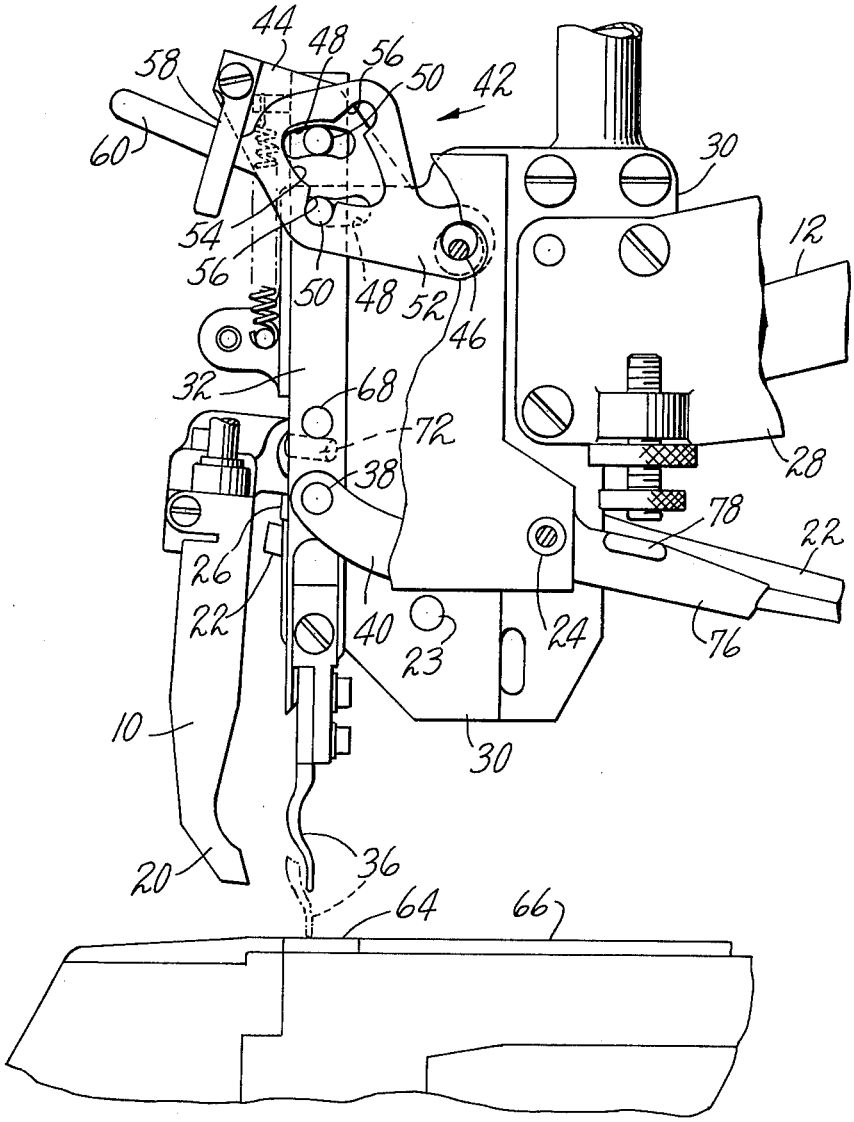
FIG. 3 is a view similar to FIG. 2 but showing a binding finger supported by the carrier.
Figure 4:
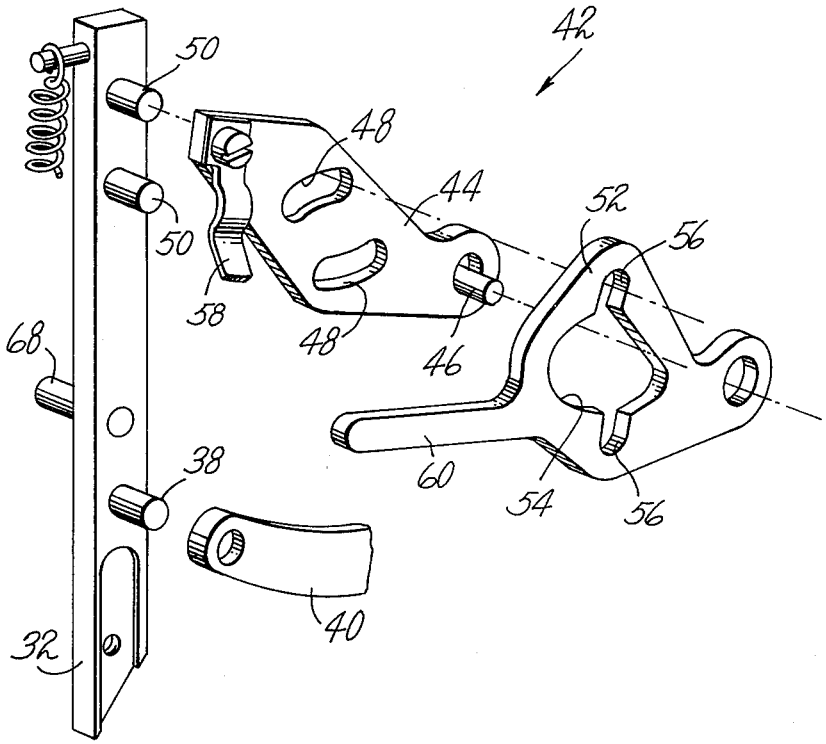
FIG. 4 is an exploded perspective view of selector means shown in FIGS. 2 and 3 of the illustrative machine and by which the path of movement of the carrier, to bring a finger element supported thereby into and out of operative position, can be selected.

In FIGS. 2 and 3, the operative position of the gauge finger and binding finger, as the case may be, is shown in chain-dot-line, and in full line each finger is shown in a position to which it is moved from its operative position. Also in said figures, a shaped gauge block 62 and a flat gauge block 64, respectively for folding and binding operations, are also shown mounted on a work table 66 of the illustrative machine. (Further, in the case of a folding operation, a snipping knife arrangement is customarily used, while in the case of a binding operation, a wiper mechanism is customarily used; both these known mechanisms have been left out of the drawings for the sake of clarity. In addition, in each case a conventional hammer-and-anvil arrangement usually is provided; though not shown for the sake of clarity, by which a workpiece is fed through the operating locality of the illustrative machine. The selected arrangement is effective to complete and consolidate the folding whether of the margin on itself or of the binding onto the margin.)

For relatively moving the lifting bar 32 as aforesaid, a pin 68 (FIGS. 1–4) is provided which extends rearwardly of the bar, through a cut-away portion 70 of the support member 30. The pin 68 lies in the path of a further pin 72 which is supported in a boss 74 of the bracket 12. Thus, when the bracket 12, together with the creaser foot support thereon, is raised, the pin 74 engages the pin 68 thus to raise also the lifting bar. Thus, the knee-operated means comprising the cable 18 by which the creaser foot support is raised, and also the hand-operated lever 22 both constitute part of actuator means of the illustrative machine for moving the lifting bar heightwise thereof.

The pin 72 is provided with an eccentrically arranged portion by which the pin 68 is engaged. Thus, by rotating the pin 72 in the boss 74, the amount of movement of the lifting bar which takes place under the action of the lifting movement of the bracket 12 can be adjusted.

The illustrative machine also comprises auxiliary actuator means for the lifting bar 32, said means comprising an extension 76 of the lever 40, said extension constituting a further hand-operated lever which is preferably arranged adjacent the lever 22. Depression of said extension 76 is effective to raise the lifting bar, by pivotal movement of the lever 40 about the pin 24, independently of any movement of the creaser foot 20.

The extension 76 is also provided with a surface 78 co-operating with an adjustable pin 80, against which said surface 78 abuts thus to determine the lowermost, that is the operative, position of a gauge finger 34 or binding finger 36 supported by the lifting bar. Further, to adjust the operative position of a gauge finger or binding finger, the pin 46 on which the lever 44 is mounted is eccentrically supported in the support member 30, rotation of the pin thus being effective to vary the position of its eccentric portion in the machine frame.

It will thus be appreciated that, in using the illustrative machine, the change between the movements of the lifting bar desired for a binding or folding operation can readily be made by means of the lever 60. Furthermore, the gauge finger or binding finger, as the case may be, is secured to the lifting bar by a simple single-screw connection, and furthermore, the gauge block 62 or 64 required for the operation to be performed is similarly secured in the work table 66 by a simple single-screw connection. Thus, the operator can change from a binding operation to a folding operation, or vice versa, in a relatively short time and without the need for a mechanic other than the operator.

Having thus described my invention, what I claim as new and desire to secure by Letters Patent of the United States is:

1. In a cementing and folding machine having a frame, a work support, a creaser foot mounted on the frame for movement into and out of operative relation with respect to a gauge block secured to the work support, and means for feeding the margin of a flexible workpiece on said support relative to the gauge block, the improvement which comprises a carrier movably mounted above the work support and adapted to interchangeably carry a binding finger or a gauge finger in and out of cooperative relation to the gauge block, mechanism for shifting the carrier to position an appropriate one of the fingers in an edge binding mode or in an edge folding mode relative to the gauge, and selector means under the control of an operator whereby the mechanism is caused to move the selected finger from the gauge either in up-and-away movement or substantially vertical movement depending on whether the edge of the work is to be folded or the work has a binding to be folded over.

2. A machine as in claim 1 wherein the carrier is mounted on spaced supports, one of the supports being shiftable to change the operating path of the carrier under the action of said mechanism, and means for locking the carrier in its adjusted mounting position to constrain movement of the finger carried thereby along a desired path.

3. A machine as in claim 2 wherein the carrier is mounted on two spaced supports, one of which supports is a pin-and-slot connection.

4. A machine as in claim 1 wherein the carrier is supported by two lever arrangements respectively pivotally mounted on the frame, said carrier being formed with two spaced means to pivotally support either one of the two lever arrangements, the two spaced means being at different distances from the pivotal connection of the carrier with the other of said two lever arrangements.

5. A machine as in claim 1 wherein the carrier is supported by two lever arrangements each of which is mounted for pivotal movement on the frame, the carrier being formed with two pin-receiving holes for respectively accommodating a pin for selectively pivotally connecting one of the lever arrangements to the carrier, the other of the lever arrangements being connected to the carrier by a pivotal connection, the holes being differently spaced from said pivotal connection of the carrier with the other lever arrangement, whereby the difference between the two pivotal connections can be changed to alter the operating path of the carrier relative to the gauge block.

6. A machine as in claim 5 wherein one of the lever arrangements comprises a member having two slots each formed to accommodate a pin projecting from the carrier, the pins each providing a pivotal connection between the one lever arrangement and the carrier, the pins being spaced differently from the pivotal connection between the other lever arrangement and the carrier whereby, according to which pin provides the pivotal connection for said one lever arrangement, substantially vertical or up-and-away movement of the carrier relative to the gauge block is effected.

7. A machine as in claim 6 wherein the selector means comprises a locking lever formed with an aperture and a pair of recess portions respectively arranged to accommodate one of said pins when the other of the pins is disposed in the aperture.

* * * * *